US006544057B1

(12) United States Patent
Stremick et al.

(10) Patent No.: US 6,544,057 B1
(45) Date of Patent: Apr. 8, 2003

(54) CABLE MANAGEMENT SLIDE

(75) Inventors: Nathan E. Stremick, Burnsville, MN (US); Clinton D. Crosby, Apple Valley, MN (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/953,660

(22) Filed: Sep. 17, 2001

(51) Int. Cl.[7] ..... H01R 3/00
(52) U.S. Cl. ..... 439/162
(58) Field of Search ..... 439/162, 32; 174/69, 174/68; 361/727

(56) References Cited

U.S. PATENT DOCUMENTS 2,959,634 A * 11/1960 Lyon ..... 174/117 R
3,295,905 A * 1/1967 Sisk et al. ..... 174/69
3,551,612 A * 12/1970 Guentner ..... 174/69
4,092,997 A * 6/1978 Hansen ..... 137/351
4,614,383 A * 9/1986 Polley et al. ..... 174/69
4,987,442 A * 1/1991 Uemori ..... 174/69
5,819,621 A 10/1998 Ohta et al. ..... 83/282
6,161,894 A 12/2000 Champman ..... 296/155
6,327,139 B1 * 12/2001 Champion et al. ..... 174/69

* cited by examiner

*Primary Examiner*—Lynn D. Feild
*Assistant Examiner*—Phuong K T Dinh
(74) *Attorney, Agent, or Firm*—Patrick M. Hogan; Glenn W. Bowen

(57) ABSTRACT

A cable management slide system that flexibly follows the displacement of a module into and out of a cabinet housing to allow the rear access ports of the module to be connected to adjacent modules through connectors that are laterally and forwardly positioned with respect to the module. Use of cable management slides on opposite sides of the modules allows one to physically isolate the power cable for the module from the data line of the module thereby inhibiting or preventing electrical interference therebetween.

10 Claims, 3 Drawing Sheets

CABLE MANAGEMENT SLIDE

FIELD OF THE INVENTION

This invention relates generally to cable slides and, more particularly, to a cable management slide that permits a user to make lateral connections to removable rear access equipment.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

Removable rear access electronic modules or rack mounted equipment modules are well known in the art. Typically, the modules are slidable mounted so that the module can be removed and replaced from the housing supporting the modules. In order to provide for ease in removeability the access ports for the modules are located on the rear of the module. While rear access ports allow one to retain the removeability and replaceability of a module it is often times difficult to connect the module access ports to other modules in the housing if there is no rear access to the housing. That is, a user has to reach from the front of the cabinet housing to the rear of the cabinet housing in order to connect the modules ports at the rear of the housing, oftentimes without being able to actually see what he or she is doing.

The present invention provides an improvement to connecting modules by providing a cable management slide that slideably supports a module while at the same time carrying a cable from the rear of the module to a point lateral of the module where the module can easily be connected to another module or a power source through a flexible cable carrier that rollingly peels away from the slide as the module is displaced to allow a connecting cable carried thereon to maintain connectivity with the rear access ports of the module as the module is slid in or out of the cabinet housing.

Another problem encountered with removable mounted medules is that the power cables and the data transmission cables are bundled together to minimize clutter within the housing. In certain instance the power cables produce interference to the signals sent through the data transmission cables. The present invention provides means for spatially isolating the power cables and the data transmission cables to inhibit power cable interference.

BRIEF DESCRIPTION OF THE PRIOR ART

U.S. Pat. No. 5,819,621 shows an electric cable guiding device that includes two moveable blocks.

U.S. Pat. No. 6,161,894 shows flexible electric cable within a sheath.

SUMMARY OF THE INVENTION

Briefly, the invention comprises a cable management slide with a carrier that flexibly follows the displacement of a module into and out of a cabinet housing to allow the rear access ports of the module to be connected to connectors that are laterally and forwardly positioned with respect to the rear of the module. The use of cable management slides on opposite sides of the modules allows one to physically isolate the power cable for the module from the data line of the module thereby inhibiting or preventing electrical interference therebetween.

DESCRIPTION OF THE PREFERRED EMBODIMENT

Figure 1:
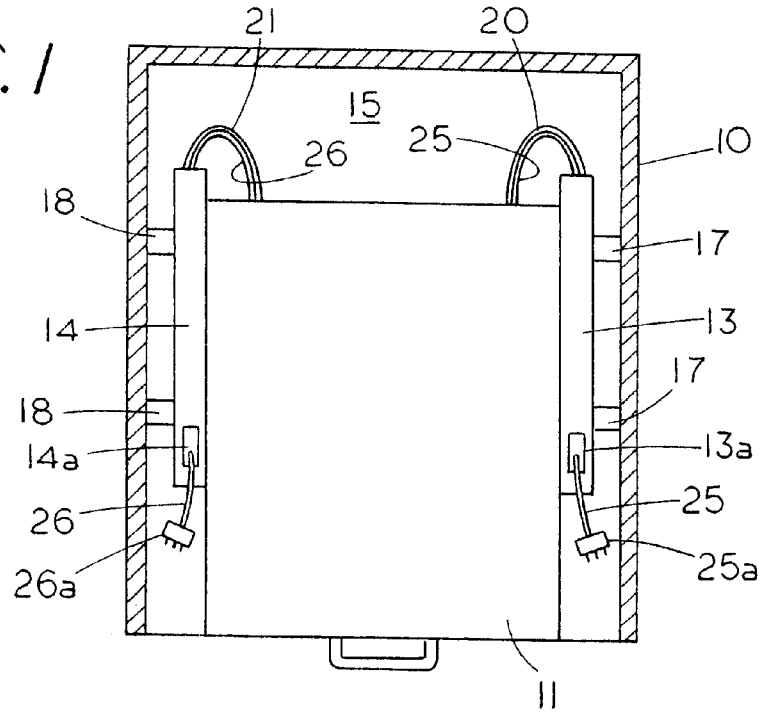
FIG. 1 is a partial sectional view of a housing and module in the retracted condition.

FIG. 1 shows a top sectional view of a cable management slide system comprising a housing 10 supporting a module 11. Located on one side of module 11 is a slide 13 which slideably supports one side of module 11 in housing 10. Similarly, located on the other side of module 11 is a second slide 13 which slideably supports an opposite side of module 11 in housing 10. While two slides are shown supporting module 11 in some applications a single slide could be used to slideably support module 11. Slide 13 is secured to housing 10 by mounts 17 and similarly slide 14 is secured to housing 10 by mounts 18.

Slide 13 includes a top opening 13*a* with a cable 25 having a connector 25*a* thereon extending outward for connection to an adjacent module. Similarly, slide 14 includes a top opening 14*a* with a cable 26 having a connector 26*a* thereon extending outward for connection to an adjacent module. Top opening 13*a* and 14*a* are positioned forward of the rear of module 11 so as to allow connections that normally would be done in the space behind the module to be made in the space lateral of the module thereby making access to connections more operator friendly.

FIG. 1 illustrates slide 13 and 14 in the retracted condition. In the retracted condition a flexible cable carrier 21 extends rearward from module 11 and into slide 14. Secured to flexible cable carrier 21 is a power cable 26. Similarly, flexible cable carrier 20 extends reward from module 11 and into slide 13. Secured to flexible cable carrier 20 is a data transmission cable 25.

Figure 2:
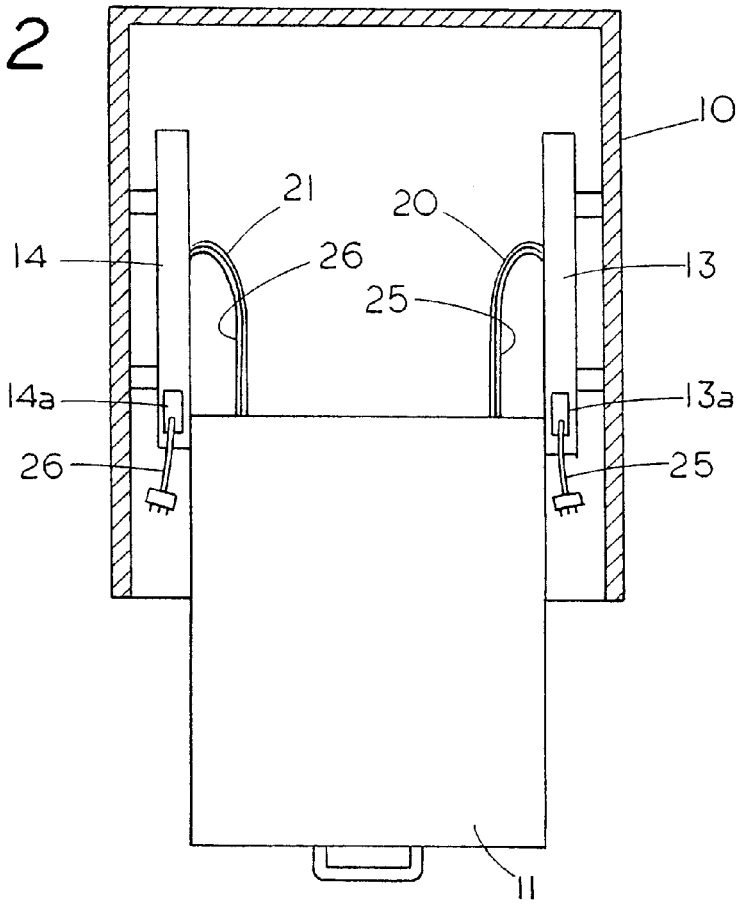
FIG. 2 is a partial sectional view of the housing and module of FIG. 1 in the extended condition.

To illustrate the displacement of module 11 within housing 10 reference should be made to FIG. 2 which shows module 11 cantileverly extending outward from housing 10. FIG. 1 shows the flexible carrier 20 extending rearwardly out of slide 13 and onto the back side of module 11. Similarly, FIG. 1 shows flexible cable carrier 21 extends rearwardly out of slide 13 and onto the back side of module 11. FIG. 2 shows that the flexible cable carrier 21 extending laterally outward from slide 14 and the flexible cable carrier 20 extending laterally outward from slide 13. As can be seen from viewing FIG. 1 and FIG. 2 the flexible carriers 20 and 21 are allowed to rollingly peel away from their respective slides to allow the cables attached thereto to follow with the module 11 as the module is displaced outwardly in housing 10.

Figure 3:
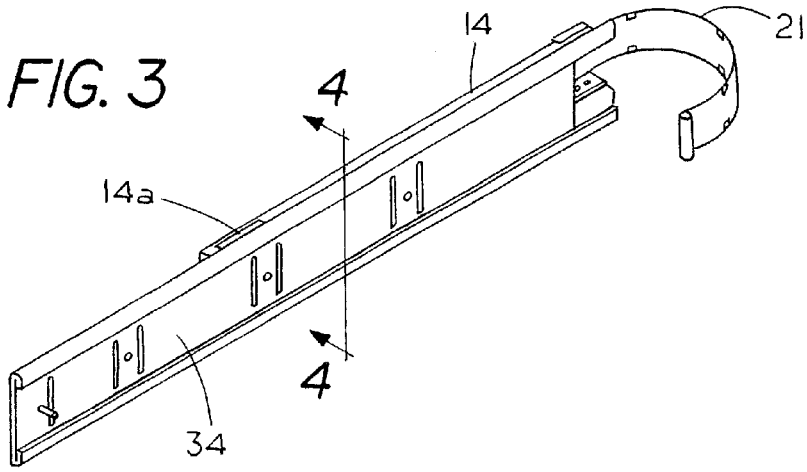
FIG. 3 is an isolated view of a slide with a flexible carrier mounted thereon.

FIG. 3 shows a perspective of a retracted slide 14 having a panel 34 for attachment to a side of a module and the flexible cable carrier 21 extending rearwardly from the end of slide 14.

Figure 4:
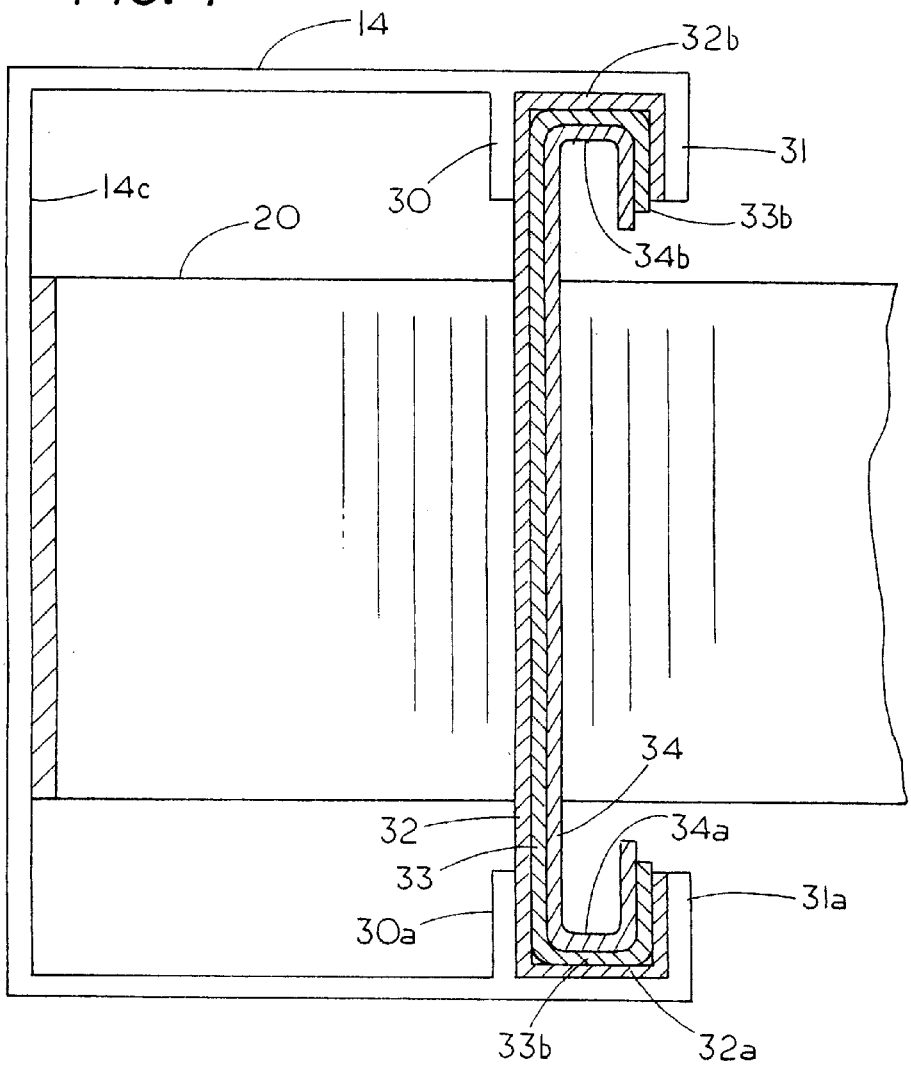
FIG. 4 is a sectional view taken along lines 4—4 of FIG. 3.

FIG. 4 shows a cross sectional view taken along lines 4—4 of FIG. 3 to reveal the slide 14 and the rails of the slide as well as the flexible cable carrier 20. Flexible cable carrier 20 is shown positioned along but not adhered to wall surface 14*c* of slide 14. To maintain the flexible cable carrier 20 in position the flexible carrier 20 has a first end secured to the rear of module 11 (FIG. 1) and a second end secured to a front portion of slide 14 with the resiliency of flexible carrier causing the flexible cable carrier 20 to normally extend along open face member 14*c* when the module is in the retracted condition. When the module 11 is pulled away from the housing 10 the flexible carrier 20 rollingly peels away from open face member 14*c* to allow the flexible carrier 20 to follow the module 11.

Slide 14 comprises a U-shaped open face member having a first top rail 30 and a second top rail 31 spaced therefrom on one end and a first bottom rail 30*a* and a second bottom rail 31*a* spaced therefrom on the other end to form a track for a set of nestable telescoping slide members 32, 33 and 34. That is, upper end 32*b* of member 32 slides within upper rails 30 and 31 and lower end 32*a* of member 32 slides within lower rails 30*a* and 31*a*. In addition, member 33 slides within the upper U-shaped member end 32*b* and the lower U-shaped member 32*a*. Similarly, member 34 upper end 34*b* slides within upper end 33*b* and member 34 lower end 34*a* slides within the lower end 33*b*. The slideability of members 32, 33 and 34 with respect to one another allows the slide members to telescope outward to cantileverly support the module 11 while the access ports on the rear of module 11 remain connected.

Figure 5:
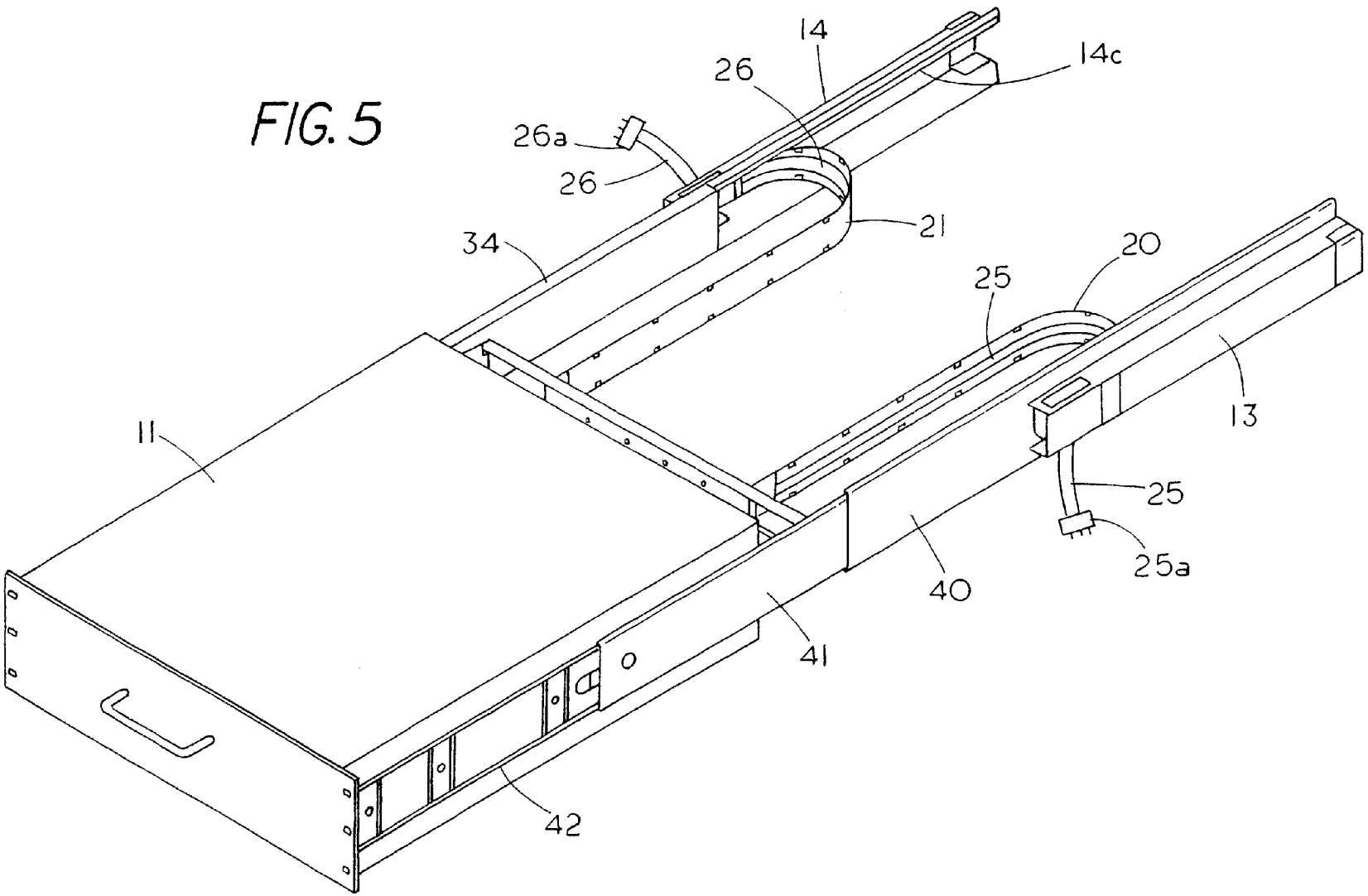
FIG. 5 is an isolated view of the cable slide management system showing the slides in a telescoped or extended position.

To illustrate the cantilever and slideable support of module 11 reference should be made to FIG. 5 which shows an isolated view of the slides 13 and 14 in the outwardly telescoped condition with module 11 cantileverly supported therebetween. In the outwardly telescoped condition the member 34 is shown positioned forward of slide 14 allowing for exposure of face 14*c* on slide 14. With the cable carrier 21 positioned along face 14*c* and member 34 slidable forward it is apparent that the carrier 21 can flex and rollingly peel away from member 34 with the forward motion of the module 11. Similarly, the flexible cable carrier 20 can follow along a similar opening in slide 13. At the same time the carriers 20 and 21 are allowed to follow the open faces of the slides the connectors 26*a* and 25*a* are maintained laterally of the module to facilitate connection to another module. In addition it is noted that the power cable can be positioned on one side of module 11 and the data transmission cable can be positioned on the opposite side to thereby inhibit or eliminate electrical interference therebetween. The cables can be extended upwardly or downwardly from slide 13 and 14 to allow for ease of connection to modules positioned above or below module 11.

In the embodiment shown the flexible carrier 20 and 21 are shown as separate members with the respective cables secured thereto by ties or clips. A further feature of the invention is that the data transmission and the power cable could be integrally formed with the flexible carrier thereby eliminate the need to secure the power and data transmission cables to a separate carrier.

The cable management system shown in FIG. 5 includes two slides; however, the cable management slide could also be made with a single slide for positioning a module in an extended or retracted condition with the slide having an open face member therein with a carrier, extending along the open face member when the slide is in a retracted condition with the carrier peeling away-from the open face member as the slide is moves from a retracted condition to an extended condition to allow the carrier or cable length to be kept at a minimum.

A further aspect of the invention is the method of connecting modules comprising the steps of mounting a module 11 on a slide 14 having an open face member 14*a* and securing one end of a flexible carrier 21 to a rear of a module 11 and extending the flexible carrier 21 within the slide 14 to allow the flexible carrier to flex as the module 11 is moved from a retracted condition to an extended condition. If two supports are used one can secure a second flexible carrier 20 to the module 11. In order to provide electrical isolation one can secure a data cable to the module in a spaced condition from a power cable to the module. The method can further include the step of forming an opening at a forward end of the slide to allow for extending a cable from a rear of the module to a position lateral of the module.

We claim:

1. A cable management slide comprising:

a housing;

a module;

a slide, said slide slideably supporting said module in said housing, said slide having an open face member therein;

a flexible carrier, said flexible carrier having a first end secured to said module and a second end secured to said slide with said flexible carrier extending along said open face member so that when said module is moved away from said housing said flexible carrier is free to peel away from said open face member to allow said flexible carrier to follow said module.

2. The cable management slide of claim 1 including:

an opening in a forward portion of said slide for extending a cable therethrough.

3. The cable management slide of claim 1 including:

a second slide, said second slide slideably supporting said module in said housing, said second slide having an open face member therein.

4. The cable management slide of claim 1 including:

a flexible power cable secured to said flexible carrier to allow said flexible power cable to follow said flexible carrier.

5. The cable management slide of claim 4 including:

a flexible data cable secured to a second flexible carrier to allow said flexible data cable to follow said second flexible carrier, said flexible data cable spaced from said flexible power cable to prevent electrical interference therebetween.

6. The cable management slide of claim 1 wherein the slide comprises a plurality of telescoping members.

7. The cable management slide of claim 6 wherein the plurality of telescoping members comprise Ushaped members slidingly nested to each other.

8. The cable management slide of claim 6 including a second slide comprising a plurality of telescoping members.

9. The cable management slide of claim 1 wherein the flexible carrier is a resilient flexible carrier.

10. The cable management slide of claim 1 wherein the carrier rollingly peels away from said slide.

* * * * *